US006225960B1

(12) United States Patent
Collins

(10) Patent No.: US 6,225,960 B1
(45) Date of Patent: May 1, 2001

(54) MICROWAVE ANTENNAS

(76) Inventor: John Louis Frederick Charles Collins, 3 Cupar Road, Largoward, Leven Fife KY9 1HX (GB)

( * ) Notice: Subject to any disclaimer, the term of this patent is extended or adjusted under 35 U.S.C. 154(b) by 0 days.

(21) Appl. No.: 09/367,983

(22) PCT Filed: Feb. 18, 1998

(86) PCT No.: PCT/GB98/00500

§ 371 Date: Aug. 23, 1999

§ 102(e) Date: Aug. 23, 1999

(87) PCT Pub. No.: WO98/37595

PCT Pub. Date: Aug. 27, 1998

(30) Foreign Application Priority Data

Feb. 22, 1997 (GB) ..... 9703748

(51) Int. Cl.[7] ..... H01Q 13/02
(52) U.S. Cl. ..... 343/786; 343/776; 343/756
(58) Field of Search ..... 343/756, 786, 343/776, 770; 333/248, 254

(56) References Cited

U.S. PATENT DOCUMENTS 4,757,324 * 7/1988 Dhanjal ..... 343/776
5,600,336 * 2/1997 Kubo ..... 343/756

FOREIGN PATENT DOCUMENTS 0 312 989 4/1989 (EP) .
95/23440 8/1995 (WO) .

* cited by examiner

*Primary Examiner*—Tho Phan
*Assistant Examiner*—James Clinger
(74) *Attorney, Agent, or Firm*—Ratner & Prestia

(57) ABSTRACT

A microwave antenna (10) is formed from a stack of generally planar elements (14–122) forming an array of horns (12) communicating with waveguides (38). The generally planar elements (14–22) are of metallized plastics. Each of these elements (14–22) has a given overall thickness which is constituted by a membrane of relatively small thickness formed (typically by vacuum forming) into a corrugated shape.

9 Claims, 7 Drawing Sheets

MICROWAVE ANTENNAS

This invention relates to antennas for receiving microwave signals.

There are known antennas comprising an planar array of horns communicating with one or more waveguide systems, and in which the horns and waveguides are formed from a sandwich of moulded planar members. The planar members may be plastics mouldings with electrically conductive surfaces formed by metallisation. See for example my published international Patent Applications WO89/09501, WO91/20109 and WO95/23440.

There remains an on-going need for improvement to ease manufacture and reduce manufacturing time and cost. It is also necessary to address the design of other than planar arrays.

Accordingly, the present invention provides an antenna comprising :

a plurality of planar members secured together in face-to-face relationship to form an array of cavities, each cavity being in communication with at least one waveguide channel;

a waveguide system and;

a single waveguide output port.

Preferably, said single output port is circular.

Preferably, said single output port is connectable to a low noise block converter.

Preferably, each of the members is a vacuum forming.

Preferably, the members are formed by vacuum forming a plastics material and thereafter metallising at least one side of the vacuum formed material.

From another aspect, the present invention provides a method of manufacturing an antenna element comprising an array of receiving horns, cylindrical cavities aligned with the receiving horns and bottom sections for the cavities, wherein the array of receiving horns is formed from a first planar member, the cylindrical cavities are formed from a second planar member in conjunction with a third planar member, and the bottom sections are formed from the third planar member in connection with a fourth planar member, each of the planar members having a given overall thickness transverse to its principal plane, said thickness being constituted by a membrane of relatively small thickness formed three-dimensionally in a generally corrugated fashion, positioning the planar members in face-to-face relationship to form an array of cavities and a waveguide system, each cavity being in communication with at least one waveguide channel, and securing the planar members together.

In a preferred form of the invention, the planar members are secured together by ultrasonic welding; for this purpose the mating faces of the planar members may be provided with ribs or the like which fuse to form weld beads during the ultrasonic welding.

Embodiments of the present invention will now be described, by way of example only, with reference to the drawings, in which.

Figure 1:
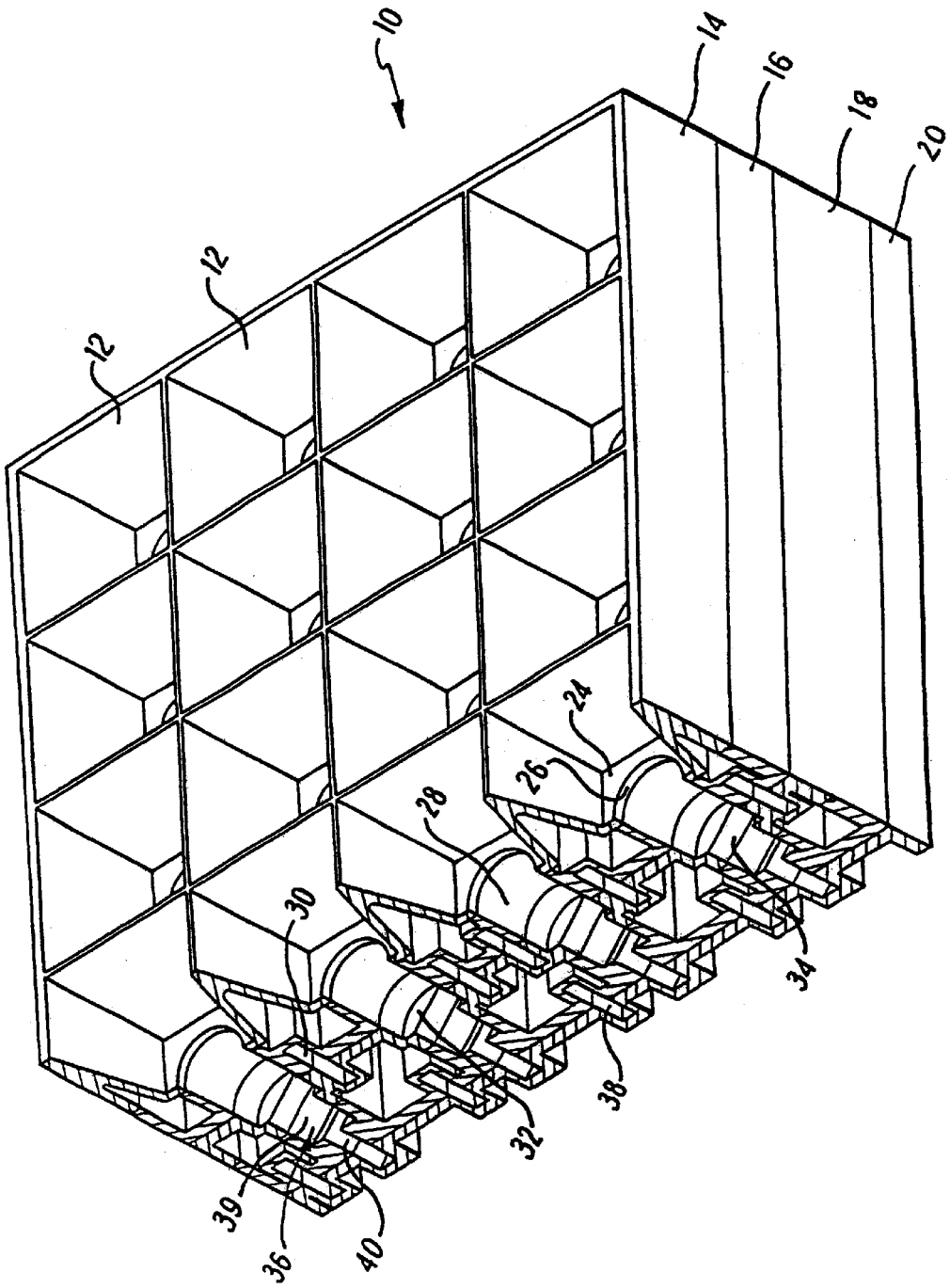
FIG. 1 is an isometric view, sectioned along a transverse plane, of an antenna element according to the present invention.

Referring particularly to FIGS. 1 to 4, an antenna element generally designated 10 in in the form of a 4×4 array of receiving horns 12. In practice, the element 10 would be assembled with like elements to provide a larger array as a single antenna. The antenna element 10 comprises four generally planar members 14–20.

The first planar member 14 is formed to provide the horns 12, each of which is of tapering square section, terminating in a lower wall 24 and circular aperture 26.

The second planar member 16 together with the upper portion of the third planar member 18 define cylindrical cavities 28 aligned with the circular apertures 26, and first closed, rectangular section channels 30 extending along the length of the antenna element 10. The cavities 29 terminate in a plane partial end wall 32 defining a D-shaped slot 34.

The lower portion of the third planar member 18 together with the fourth planar member 20 define bottom sections 36 to the horn cavities, and second closed, rectangular section passages 38. Each bottom section 36 has an upper part 39 corresponding to the D-shaped slots 34, and a lover part 40 forming an open-topped channel communicating with one of the second passages 38.

Figure 2:
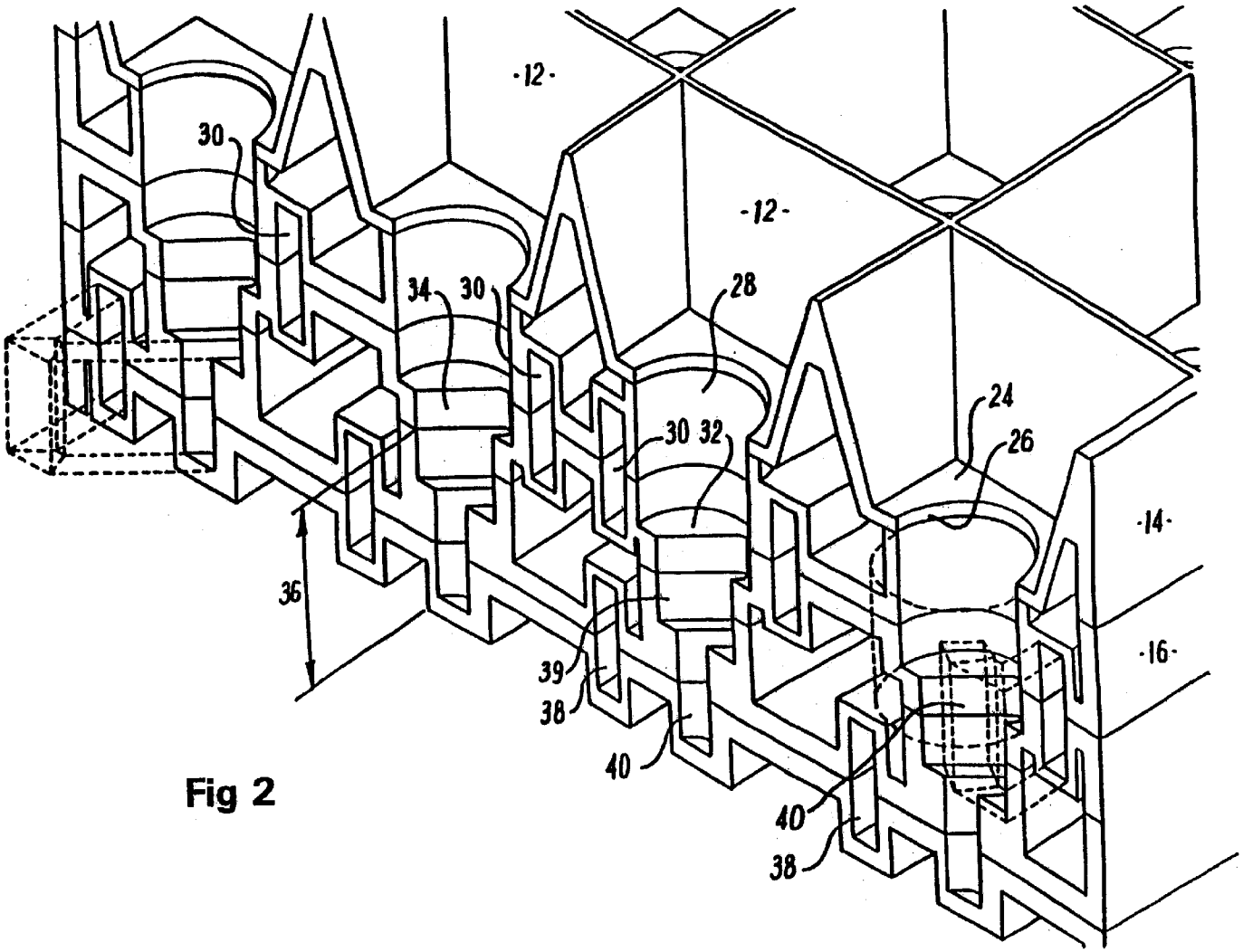
FIG. 2 shows part of FIG. 1 in greater detail, to an enlarged scale.

The first channels 30 communicate with the cavities 26 by means of passageways 40 as indicated in FIG. 2.

Each of the planar members 14–20 is separately formed by vacuum forming of a suitable plastics material. Techniques of and materials for vacuum forming are well known per se and will not therefore be described in detail herein.

Figure 3:
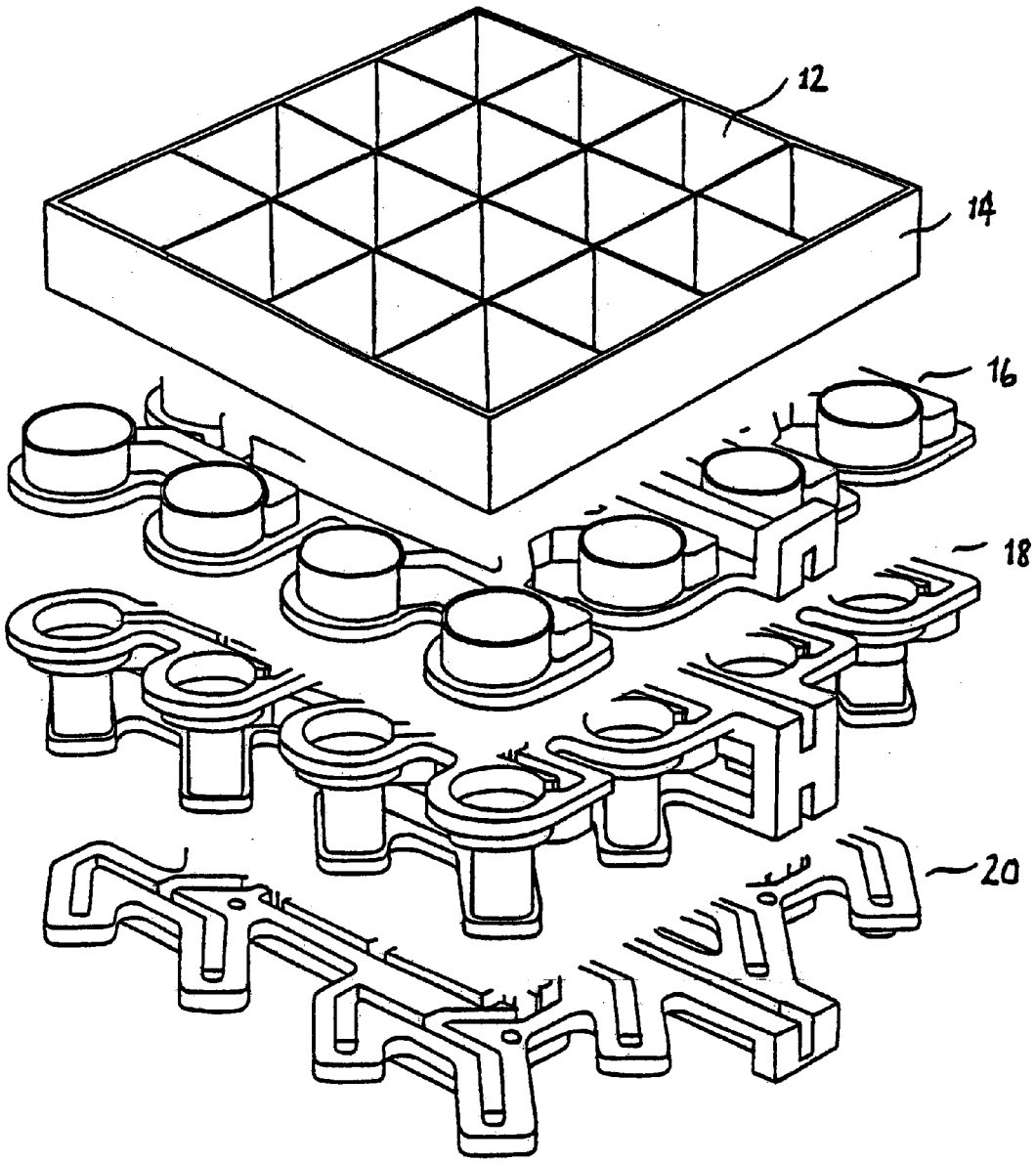
FIG.3 shows an exploded view from above of an antenna element according to the present invention.
Figure 4:
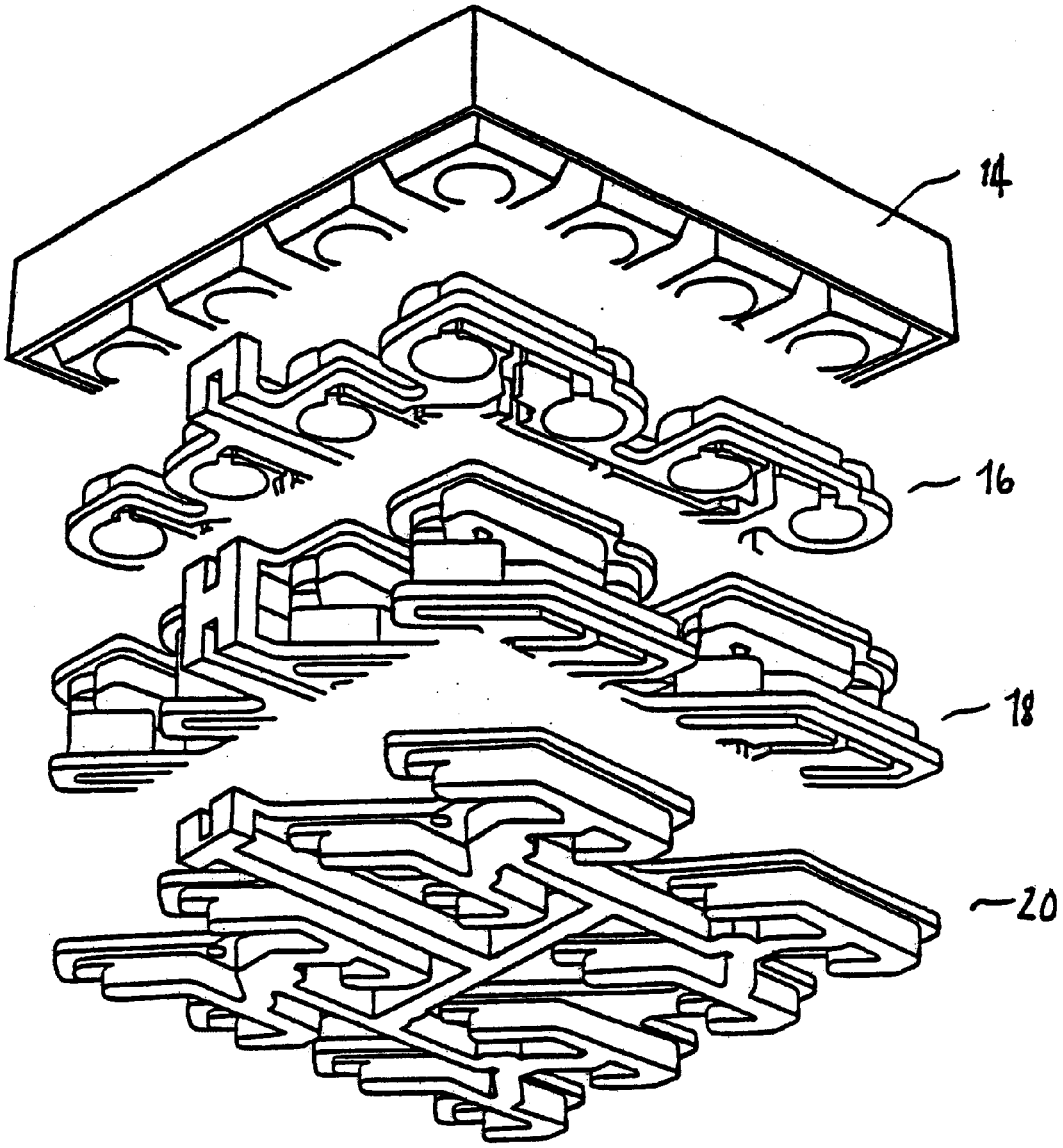
FIG. 4 shows an exploded view from below of an antenna element according to the present invention.
Figure 5:
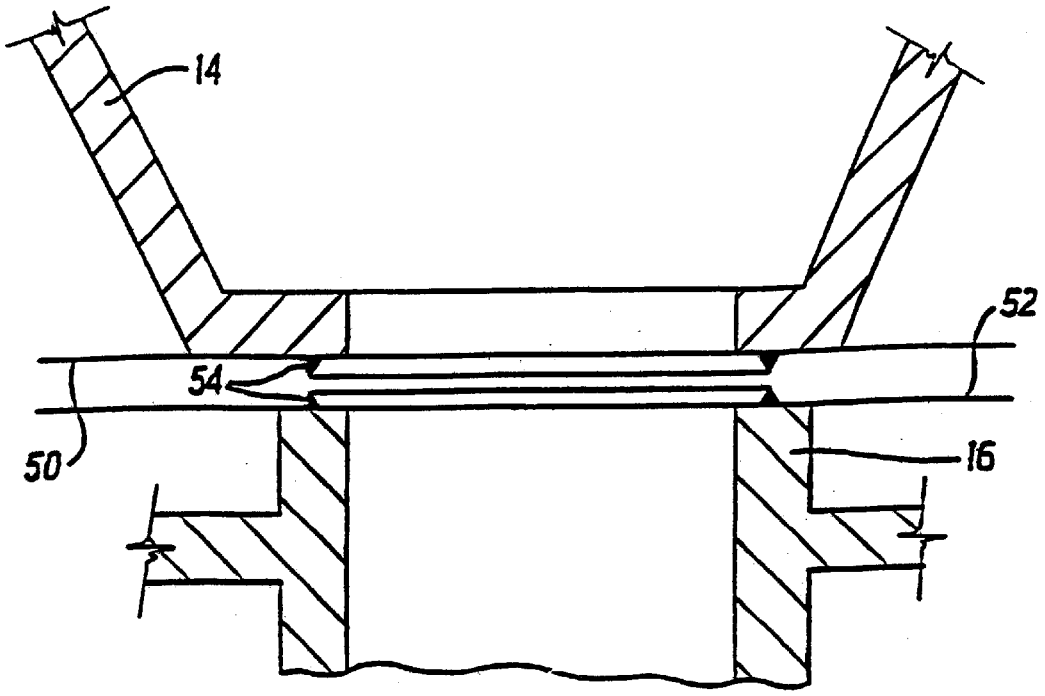
FIG. 5 illustrates a preferred means used in securing together parts of the assembly of FIGS. 1 and 2.
Figure 7:
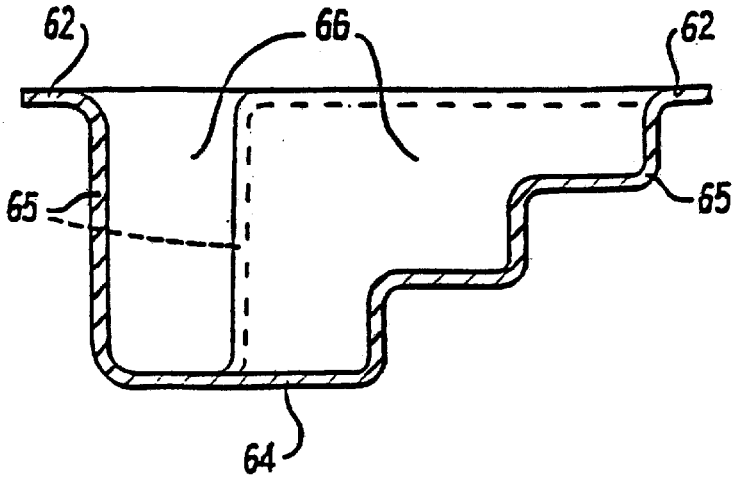
FIG. 7 is an enlarged cross-sectional scrap view on the line 5—5 of FIG. 6.
Figure 6:
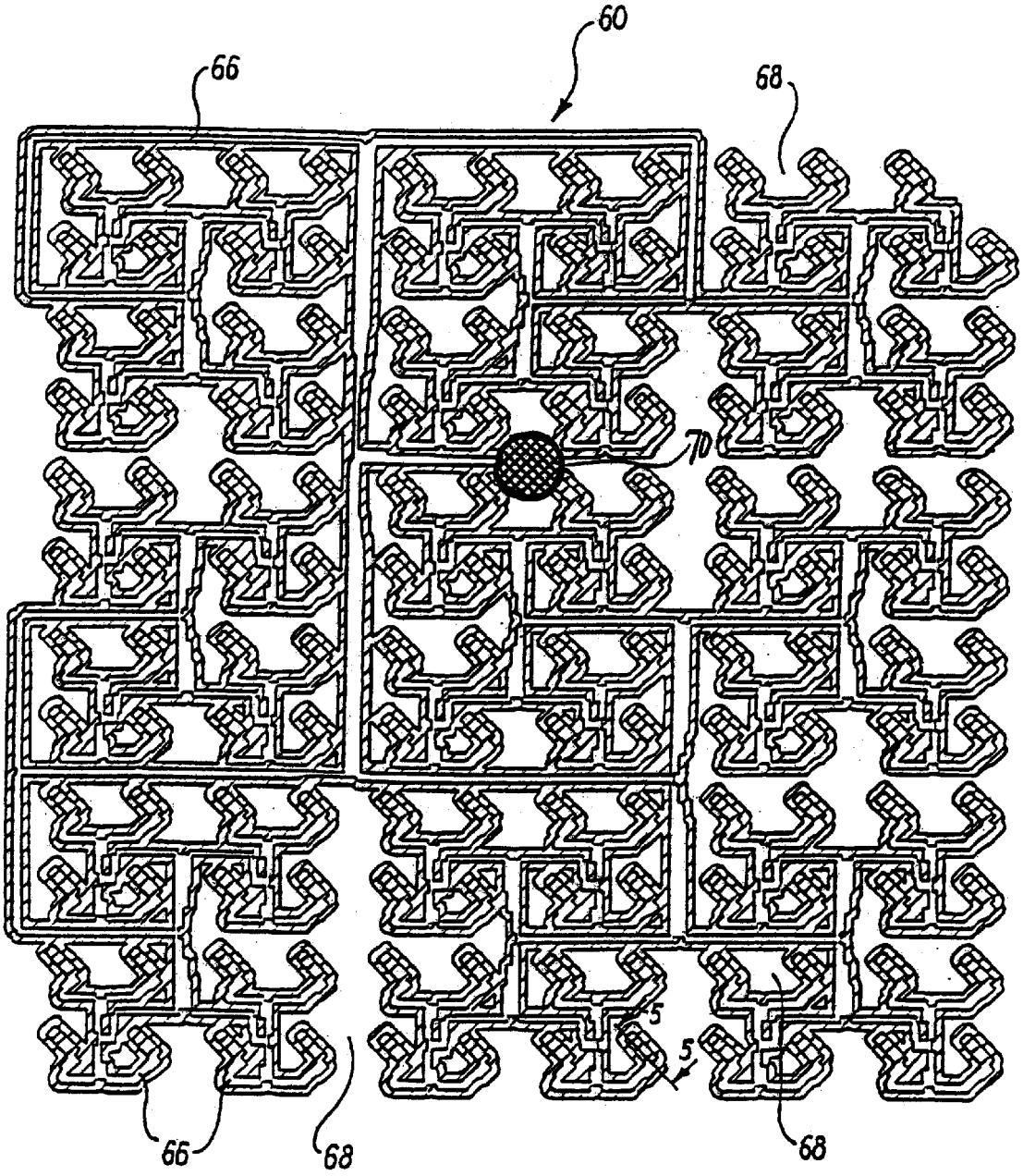
FIG. 6 is a plan view illustrating the construction of a modified form of waveguide channel showing the single circular output port.
Figure 8:
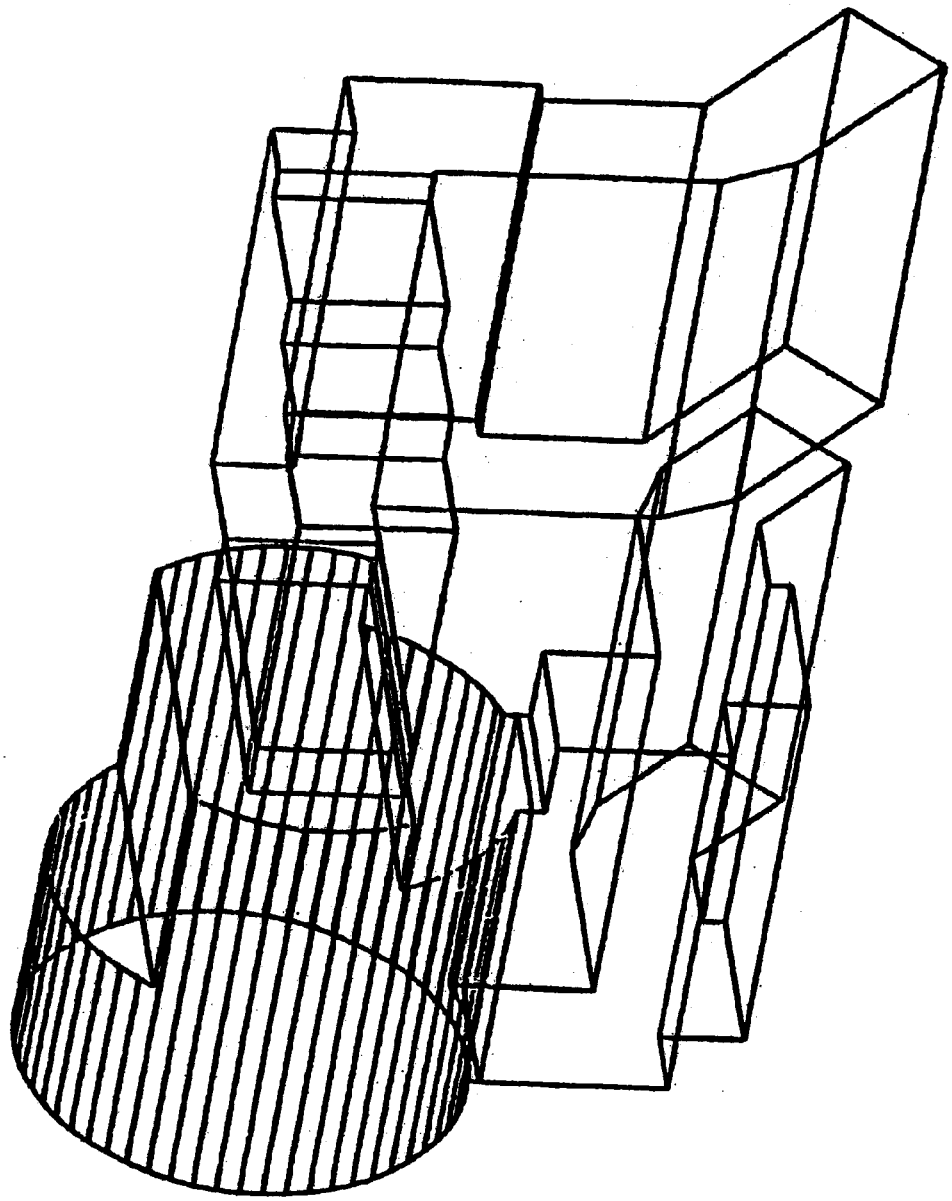
FIG. 8 is an enlarged detail of the single circular output port.
Figure 8:
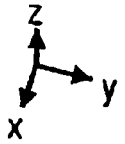

FIGS. 3 and 4 show the construction of the third planar member 18, previously formed from separate members, formed as a single mould.

The walls of the horns, cavities and channels have the effect of providing a corrugated formation to each member, thus giving a reasonable degree of rigidity which is increased when the four members are secured together.

After vacuum forming, one side, as appropriate, of each member is metallised in any suitable fashion, and thus when the members are secured together the surfaces of the horns, cavities and channels with are adjacent the received microwave radiation are conductive metallised surfaces. The channels 30 and 38 thus act as waveguides for differently polarised microwave signals separated by the conformation of the cavities 26, as is known per se.

The four members may be secured together in any suitable manner. For example, they may be secured together by adhesive. A preferred feature of the present invention, however, is to secure the planar members together by means of ultrasonic welding. For this purpose, as illustrated in FIG. 3, the mating faces such as the lower face 50 of the first member 14 and the upper face 52 of the second member 16, are provided with ribs 54 which fuse to form continuous welded beads during ultrasonic welding.

Referring to FIGS. 5 to 8, there is illustrated an alternative construction of a moulded element 60 which partially defines the wave guides, for example in substitution for the element 20 in the above embodiment.

FIG. 4 shows a 12×12 array, but it will be understood that the arrangement can be applied to any desired size of array.

The element 60 is once again a vacuum forming in which a single membrane of material is formed to provide upper faces 62 and lower faces 64 joined by side webs 65 to define waveguide channels 66. In this embodiment, however, the upper faces 62 are defined only as flanges in the vicinity of the waveguide channels 66, and elsewhere the material is cut away to form void spaces 68. The singular circular output port 70 provides an interface for a low noise block converter interface.

It is envisaged that this antenna will also be of use in communication and automotive purposes.

The reduction in the number of separate mouldings results in a 25% reduction in assembly steps.

What is claimed is:

1. An antenna comprising:

a plurality of planar members secured together in face-to-face relationship to form an array of cavities and at least one waveguide channel, each cavity being in communication with said at least one wave-guide channel;

said at least one waveguide channel forming a waveguide system; and said waveguide system having a single waveguide output port.

2. An antenna as claimed in claim 1 wherein said single output port is circular.

3. An antenna as claimed in claim 1 wherein said single output port is connectable to a low noise block converter.

4. An antenna as claimed in claim 1 wherein each of the members is a vacuum forming.

5. An antenna as claimed in claim 1 wherein the members are formed by vacuum forming a plastics material and thereafter metallising at least one side of the vacuum formed material.

6. A method of manufacturing an antenna element comprising an array of receiving horns, cylindrical cavities aligned with the receiving horns and bottom sections for the cavities, wherein the array of receiving horns is formed from a first planar member, the cylindrical cavities are formed from a second planar member in conjunction with a third planar member, and the bottom sections are formed from the third planar member in connection with a fourth planar member, each of the planar members having a given overall thickness transverse to its principal plane, said thickness being constituted by a membrane of relatively small thickness formed three-dimensionally in a generally corrugated fashion, positioning the planar members in face-to-face relationship to form an array of cavities and a waveguide system, each cavity being in communication with at least one waveguide channel, and securing the planar members together.

7. A method of manufacturing an antenna element as claimed in claim 6 wherein the planar members are secured together by ultrasonic welding.

8. A method of manufacturing an antenna element as claimed in claim 7 wherein the mating faces of the planar members are provided with ribs or the like which fuse to form weld beads during the ultrasonic welding.

9. An antenna comprising:

first, second, third & fourth planar members secured together in face-to-face relationship;

the first planar member forming an array of receiving horns;

the second and third planar members together defining cylindrical cavities aligned with the receiving horns and first waveguide channels;

the third and fourth planar members together defining bottom sections for the cavities and second waveguide channels; and in which the first and second waveguide channels communicate with a single waveguide output port exiting said forth planar member.

* * * * *